US008026937B2

(12) United States Patent
Miyadera

(10) Patent No.: US 8,026,937 B2
(45) **Date of Patent: *Sep. 27, 2011**

(54) IMAGE FORMING METHOD, IMAGE FORMING APPARATUS AND TONER IMAGE PATTERN

(75) Inventor: Tatsuya Miyadera, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 695 days.

This patent is subject to a terminal disclaimer.

(21) Appl. No.: 12/003,975

(22) Filed: Jan. 4, 2008

(65) Prior Publication Data

US 2008/0212986 A1 Sep. 4, 2008

(30) Foreign Application Priority Data

Jan. 11, 2007 (JP) ..... 2007-003914

(51) Int. Cl.
*B41J 2/385* (2006.01)
*G03G 15/01* (2006.01)

(52) U.S. Cl. ..... 347/116; 399/301

(58) Field of Classification Search ..... 347/116, 347/229, 234, 235, 248–250; 399/301, 38–41
See application file for complete search history.

(56) References Cited

U.S. PATENT DOCUMENTS 7,133,056 B2 * 11/2006 Tanaka et al. ..... 347/116
2006/0039722 A1 2/2006 Ehara
2006/0139433 A1 * 6/2006 Yoshida ..... 347/116
2007/0172264 A1 * 7/2007 An ..... 399/301
2008/0170868 A1 * 7/2008 Miyadera ..... 399/40

FOREIGN PATENT DOCUMENTS

JP 11-065208 3/1999
JP 2002-244393 8/2002
JP 2006-058415 3/2006

* cited by examiner

*Primary Examiner* — Hai C Pham
(74) *Attorney, Agent, or Firm* — Ipusa, PLLC

(57) ABSTRACT

An image forming method exposes image bearing members by simultaneously reflecting light beams corresponding to different colors by different reflection surfaces of a polygon mirror, transforms electrostatic latent images formed on the image bearing members into toner images for correction, transfers the toner images in an overlapping manner onto a transfer body, and calibrates overlapping positions of the toner images based on an optical detection of the toner images. The toner images are arranged at positions on the transfer body such that the toner images of different colors have no overlap therebetween, even if the toner images shift in a direction perpendicular to the transport direction due to a color registration error. Two first toner images simultaneously formed by two corresponding light beams reflected by one reflection surface of the polygon mirror are arranged adjacent to each other in a transport direction of the transfer body, and are sandwiched by two second toner images simultaneously formed by the two corresponding light beams reflected by the one reflection surface of the polygon mirror along the transport direction.

21 Claims, 8 Drawing Sheets

IMAGE FORMING METHOD, IMAGE FORMING APPARATUS AND TONER IMAGE PATTERN

BACKGROUND OF THE INVENTION

1. Field of the Invention

The present invention generally relates to image forming methods, image forming apparatuses and toner image patterns, and more particularly to an image forming method for calibrating a color registration error caused by a positional error of a plurality of color toner images that are formed on a transfer body, an image forming apparatus which employs such an image forming method, and a toner image pattern suited for use by such an image forming method.

2. Description of the Related Art

Image forming apparatuses typified by color copying machines and color laser printers include tandem type image forming apparatuses. In one example of the tandem type image forming apparatus, 4 color toner images of yellow, cyan, magenta and black are successively transferred from respective photoconductive bodies onto a transfer body, such as a transfer belt or a transfer sheet or medium (for example, paper). For this reason, a color registration error may occur if an error is generated in relative positions of the 4 color toner images. Because the color registration error greatly affects the quality of the color image that is formed by fixing the 4 color toner images on the transfer medium, it is important to minimize the color registration error in the tandem type image forming apparatus.

One example of a conventional method of calibrating the color registration error is proposed in a Japanese Laid-Open Patent Application No. 11-65208. According to this conventional method, toner images $tmn_Y$, $tmn_C$, $tmn_K$ and $tmn_M$ (n=1, 2) for correction of the 4 colors yellow, cyan, black and magenta, are formed on a transport belt which transports a transfer medium in a transport direction A, as shown in FIG. 1. The toner images $tmn_Y$, $tmn_C$, $tmn_K$ and $tmn_M$ are detected by an optical detection means, and positional errors among the toner images $tmn_Y$, $tmn_C$, $tmn_K$ and $tmn_M$ are obtained from a detection result of the optical detection means. An exposure unit is controlled based on the obtained positional errors, by changing an exposure start time of the exposure unit, for example.

In the exposure unit which exposes a photoconductive body that is provided with respect to each of the 4 colors, laser beams from 4 laser light sources are reflected by reflection surfaces of a polygon mirror which rotates. An outer peripheral surface of each photoconductive body, which has a cylindrical shape, is exposed in an axial direction of the photoconductive body by a main scan of a corresponding laser beam. In addition, the photoconductive body rotates about its axis, which causes the outer peripheral surface of the photoconductive body to be exposed in a circumferential direction (that is, the transport direction A) by a sub scan of the corresponding laser beam. For example, in the exposure unit, the laser beams for exposing the photoconductive bodies that are provided with respect to the colors yellow and cyan are simultaneously reflected by one reflection surface of the polygon mirror, and at the same time, the laser beams for exposing the photoconductive bodies that are provided with respect to the colors black and magenta are simultaneously reflected by another reflection surface of the polygon mirror.

The toner images $tmn_Y$, $tmn_C$, $tmn_K$ and $tmn_M$ for correction include first toner images $tm\mathbf{1}_Y$, $tm\mathbf{1}_C$, $tm\mathbf{1}_K$ and $tm\mathbf{1}_M$ made up of strips that have a linear portion forming an angle of 45 degrees with respect to both a main scan direction and a sub scan direction, and second toner images $tm\mathbf{2}_Y$, $tm\mathbf{2}_C$, $tm\mathbf{2}_K$ and $tm\mathbf{2}_M$ made up of strips that are arranged at predetermined intervals in the sub scan direction and have a linear portion parallel to the main scan direction, as shown in FIG. 1. However, because the toner images $tmn_Y$, $tmn_C$, $tmn_K$ and $tmn_M$ for correction are arranged at both ends of the transfer belt along the main scan direction, the effects of errors, such as an error in an optical system of the exposure unit, appear conspicuously in terms of the positions where the toner images $tmn_Y$, $tmn_C$, $tmn_K$ and $tmn_M$ are formed. Particularly, the first toner image $tm\mathbf{1}_Y$ or $tm\mathbf{1}_C$ that is formed by reflecting the corresponding laser beam by one reflection surface of the polygon mirror and the first toner image $tm\mathbf{1}_K$ or $tm\mathbf{1}_M$ that is formed by simultaneously reflecting the corresponding laser beam by another reflection surface of the polygon mirror shift in the main scan direction due to the effects of the errors. Consequently, depending on the error, the first toner image $tm\mathbf{1}_C$ and the first toner image $tm\mathbf{1}_K$ may be formed in an overlapping manner as shown in FIG. 2, for example, and in such a case, it becomes impossible to detect the first toner images $tm\mathbf{1}_C$ and $tm\mathbf{1}_K$ in a normal manner.

SUMMARY OF THE INVENTION

Accordingly, it is a general object of the present invention to provide a novel and useful image forming method, image forming apparatus and toner image pattern, in which the problems described above are minimized.

Another and more specific object of the present invention is to provide an image forming method, an image forming apparatus and a toner image pattern, which can prevent an overlap of toner images for correction, of different colors, that would otherwise make it impossible to detect the toner images for correction in a normal manner.

According to one aspect of the present invention, an image forming method comprises exposing a plurality of image bearing members by simultaneously reflecting a plurality of light beams from a plurality of light sources by different reflection surfaces of a polygon mirror which has a plurality of reflection surfaces and is rotated in one direction, the plurality of light beams corresponding to a plurality of different colors; transforming electrostatic latent images formed on each of the plurality of image bearing members into toner images for correction; transferring the toner images on each of the image bearing members in an overlapping manner onto a transfer body that is transported in a transport direction; and calibrating overlapping positions of the toner images based on an optical detection of the toner images on the transfer body, wherein the toner images are arranged at positions on the transfer body such that the toner images of different colors have no overlap therebetween even if the toner images shift in a direction perpendicular to the transport direction due to a color registration error, each of the toner images on the transfer body includes a first toner image having a linear portion arranged at an angle greater than 0 and less than 90 degrees with respect to the transport direction, and a second toner image having a linear portion arranged perpendicularly to the transport direction, and two first toner images simultaneously formed by two corresponding light beams reflected by one reflection surface of the polygon mirror are arranged adjacent to each other in the transport direction, and two second toner images simultaneously formed by the two corresponding light beams reflected by the one reflection surface of the polygon mirror are arranged to sandwich the two first toner images along the transport direction.

According to another aspect of the present invention, an image forming apparatus comprises a plurality of image bearing members; an exposure unit configured to simultaneously reflect a plurality of light beams from a plurality of light sources by different reflection surfaces of a polygon mirror which has a plurality of reflection surfaces and is rotated in one direction, the plurality of light beams corresponding to a plurality of different colors; an image processing unit configured to transform electrostatic latent images formed on each of the plurality of image bearing members into toner images for correction, and to transfer the toner images on each of the image bearing members in an overlapping manner onto a transfer body that is transported in a transport direction; and a processing unit configured to calibrate overlapping positions of the toner images based on an optical detection of the toner images on the transfer body, wherein the toner images are arranged at positions on the transfer body such that the toner images of different colors have no overlap therebetween even if the toner images shift in a direction perpendicular to the transport direction due to a color registration error, each of the toner images on the transfer body includes a first toner image having a linear portion arranged at an angle greater than 0 and less than 90 degrees with respect to the transport direction, and a second toner image having a linear portion arranged perpendicularly to the transport direction, and two first toner images simultaneously formed by two corresponding light beams reflected by one reflection surface of the polygon mirror are arranged adjacent to each other in the transport direction, and two second toner images simultaneously formed by the two corresponding light beams reflected by the one reflection surface of the polygon mirror are arranged to sandwich the two first toner images along the transport direction.

According to still another aspect of the present invention, a toner image pattern for use by an image forming method or apparatus which exposes a plurality of image bearing members by simultaneously reflecting a plurality of light beams from a plurality of light sources by different reflection surfaces of a polygon mirror which has a plurality of reflection surfaces and is rotated in one direction, the plurality of light beams corresponding to a plurality of different colors; transforms electrostatic latent images formed on each of the plurality of image bearing members into toner images for correction; transfers the toner images on each of the image bearing members in an overlapping manner onto a transfer body that is transported in a transport direction; and calibrates overlapping positions of the toner images based on an optical detection of the toner images on the transfer body, the toner image pattern comprising the toner images arranged at positions on the transfer body such that the toner images of different colors have no overlap therebetween even if the toner images shift in a direction perpendicular to the transport direction due to a color registration error; wherein each of the toner images on the transfer body includes a first toner image having a linear portion arranged at an angle greater than 0 and less than 90 degrees with respect to the transport direction, and a second toner image having a linear portion arranged perpendicularly to the transport direction; and two first toner images simultaneously formed by two corresponding light beams reflected by one reflection surface of the polygon mirror are arranged adjacent to each other in the transport direction, and two second toner images simultaneously formed by the two corresponding light beams reflected by the one reflection surface of the polygon mirror are arranged to sandwich the two first toner images along the transport direction.

Other objects and further features of the present invention will be apparent from the following detailed description when read in conjunction with the accompanying drawings.

DESCRIPTION OF THE PREFERRED EMBODIMENTS

A description will be given of embodiments of an image forming method, an image forming apparatus and a toner image pattern according to the present invention, by referring to FIG. 3 and the subsequent figures.

In the embodiment described hereunder, the present invention is applied to a tandem type color laser printer. However, as is evident to those skilled in the art, the application of the present invention is not limited to the color laser printer, and the present invention is similarly applicable to image forming apparatuses in general which employ an electrophotography technique, such as color copying machines and facsimile machines.

Figure 3:
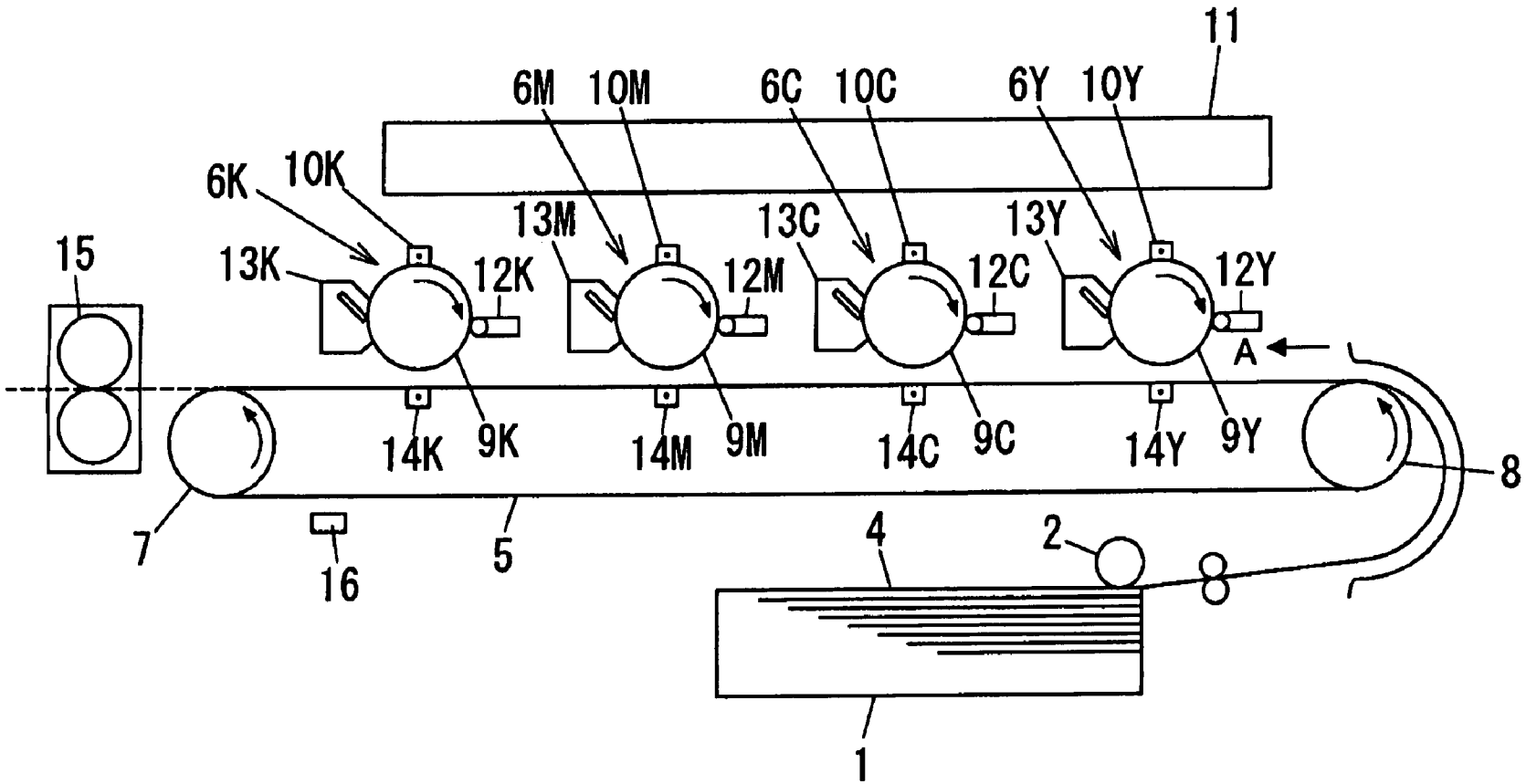
FIG. 3 is a schematic diagram showing a general structure of a part of an image forming apparatus in an embodiment of the present invention.
Figure 4:
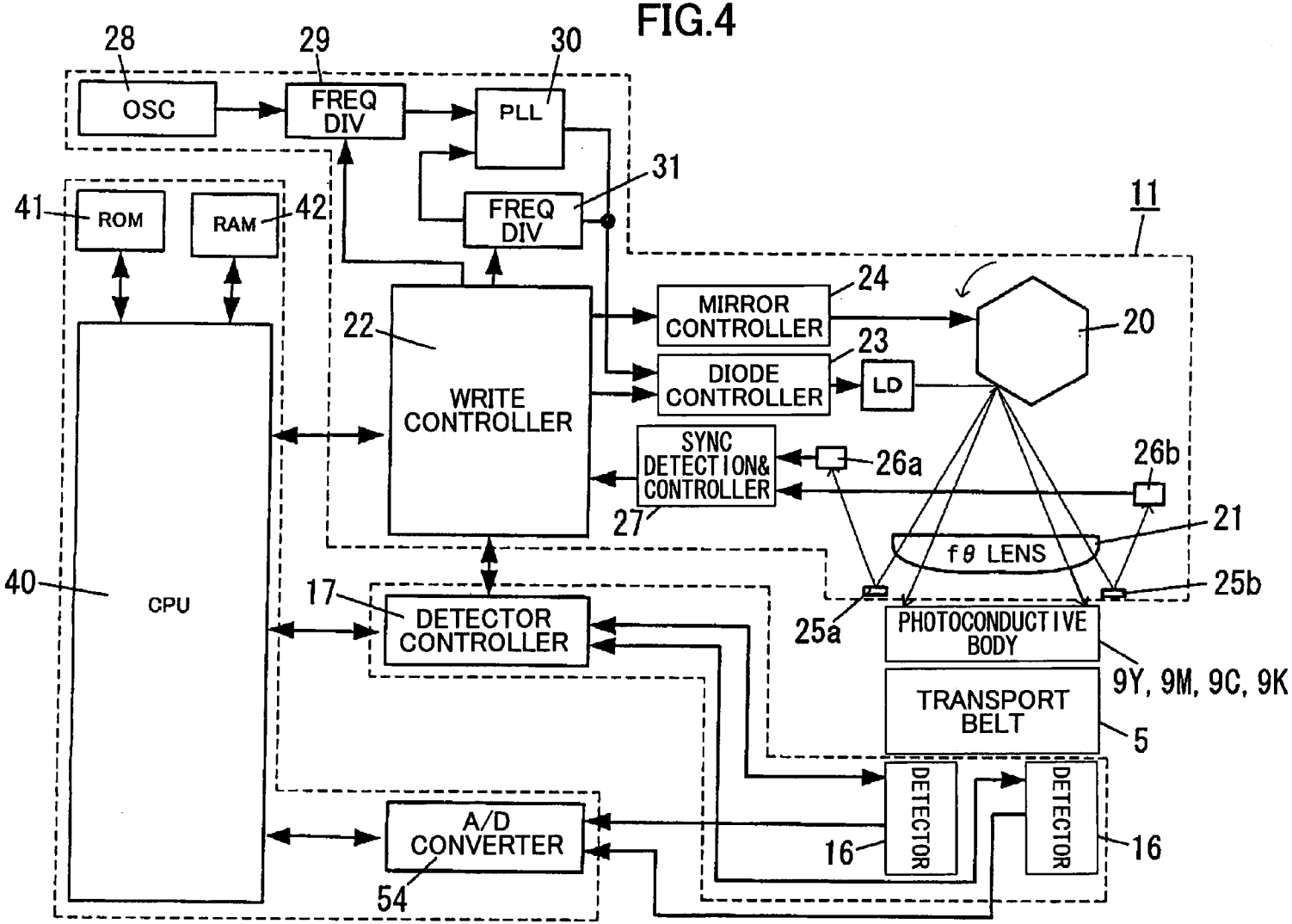
FIG. 4 is a system block diagram showing a part of the image forming apparatus.

FIG. 3 is a schematic diagram showing a general structure of a part of the image forming apparatus in an embodiment of the present invention, and FIG. 4 is a system block diagram showing a part of the image forming apparatus.

In FIG. 3, first, second, third and fourth image processing parts 6Y, 6C, 6M and 6K, respectively for forming images of different colors, namely, yellow (Y), cyan (C), magenta (M) and black (K) images (toner images), are arranged along a transport belt 5 which transports a transfer sheet (or medium) 4, as a transfer body, in a transport direction A. The transport belt 5 is provided between a driving roller 8 which is driven by a motor (not shown) and a following roller 7 which rotates by following the movement of the transport belt 5. The rollers 7 and 8 rotate in directions indicated by arrows in FIG. 3.

A medium supply tray 1 which accommodates a plurality of transfer media 4 is provided under the transport belt 5. A top transfer medium 4 of the transfer media 4 that are stacked and accommodated in the medium supply tray 1 is supplied to the transport belt 5 by a supply roller 2 and is adhered on the transport belt 5 by electrostatic adhesion when forming an image on the transfer medium 4. The transfer medium 4 adhered on the transport belt 5 is transported to the first image processing part 6Y where a yellow toner image is formed. The first image processing part 6Y includes a cylindrical photoconductive body 9Y which forms an image bearing member, and a charging unit 10Y, a exposure unit 11, a developing unit 12Y and a cleaning unit 13Y that are arranged in a periphery of the first image processing part 6Y. The second, third and fourth image processing parts 6C, 6M and 6K have structures similar to that of the first image processing part 6Y, respectively including photoconductive bodies 9C, 9M and 9K, charging units 10C, 10M and 10K, the exposure unit 11, developing units 12C, 12M and 12K, and cleaning units 13C, 13M and 13K.

Figure 5:
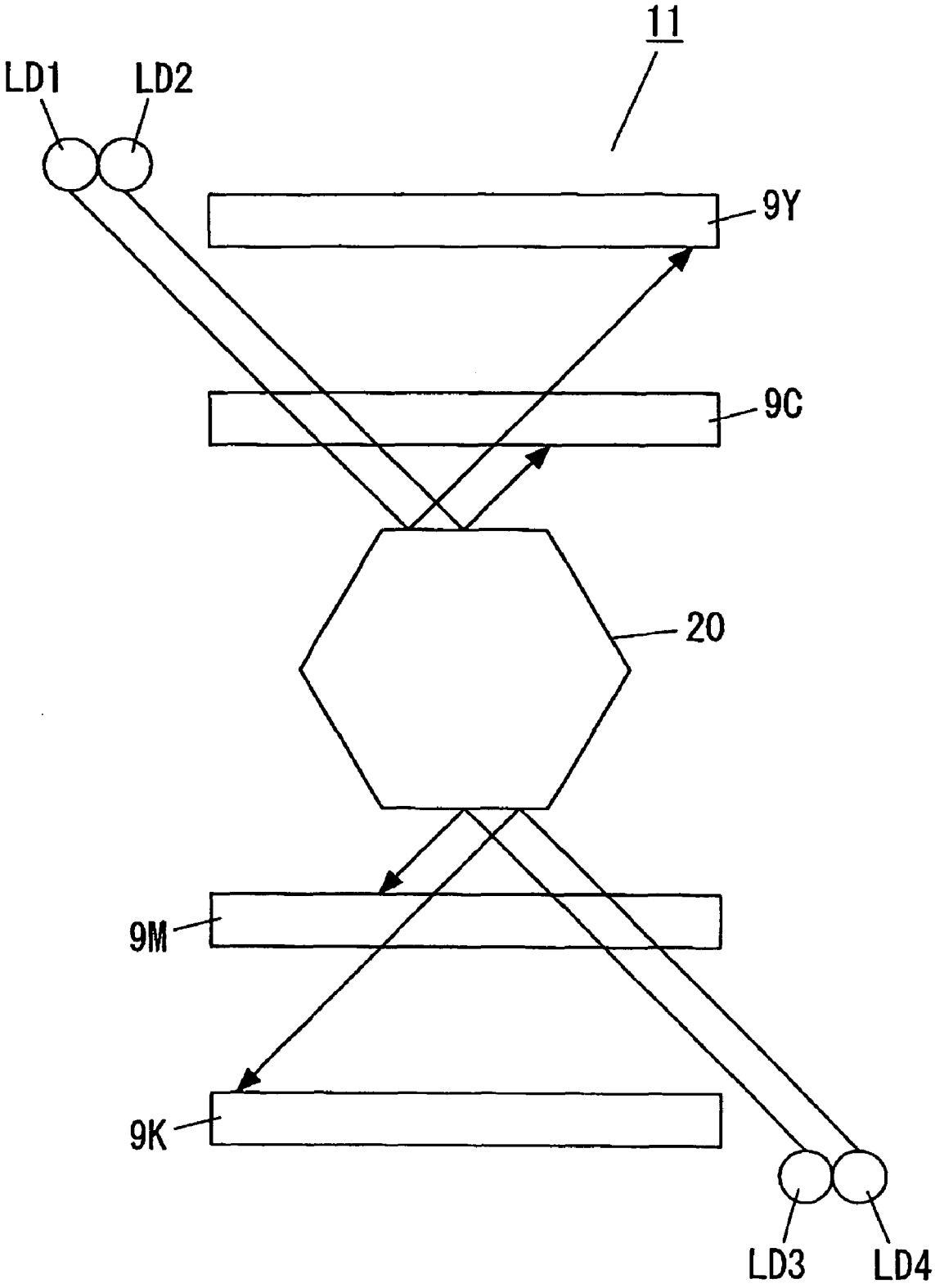
FIG. 5 is a schematic diagram showing a general structure of an exposure unit.

FIG. 5 is a schematic diagram showing a general structure of the exposure unit 11. The exposure unit 11 includes a total of 4 laser light sources LD1, LD2, LD3 and LD4 that are formed by laser diodes and provided with respect to the photoconductive bodies 9Y, 9C, 9M and 9K with a one-to-one correspondence, a polygon mirror 20 having a plurality of reflection surfaces for reflecting laser beams emitted from the laser light sources LD1 through LD4, and an optical system including an fθ lens 21 for converging reflected laser beams from the polygon mirror 20 on surfaces of the photoconductive bodies 9Y, 9C, 9M and 9K. The surfaces of the cylindrical photoconductive bodies 9Y, 9C, 9M and 9K are exposed in an axial direction by a main scan by rotating the polygon mirror 20, and the surfaces of the cylindrical photoconductive bodies 9Y, 9C, 9M and 9K are exposed in a circumferential direction (that is, the transport direction A of the transfer medium 4) by a sub scan by rotating the photoconductive bodies 9Y, 9C, 9M and 9K about axes thereof. In the exposure unit 11, the laser beams emitted from the laser light sources LD1 and LD2 for exposing the surfaces of the photoconductive bodies 9Y and 9C are simultaneously reflected by one reflection surface of the polygon mirror 20, and at the same time, the laser beams emitted from the laser light sources LD3 and LD4 for exposing the surfaces of the photoconductive bodies 9M and 9K are simultaneously reflected by another reflection surface of the polygon mirror 20. In the exposure unit 11 shown in FIG. 5, the one reflection surface and the other reflection surface of the polygon mirror 20 are provided at mutually opposite positions along a radial direction of the polygon mirror 20.

When forming the color image, a color separation image signal, which is obtained in advance from a color image reading apparatus or a printer driver of a personal computer, is subjected to a color conversion process in a CPU 40 shown in FIG. 4 and converted into color image data of yellow (Y), cyan (C), magenta (M) and black (K). The color image data of yellow (Y), cyan (C), magenta (M) and black (K) are output to a write controller 22 of the exposure unit 11.

First, when the image formation starts, the surfaces of each of the photoconductive bodies 9Y, 9C, 9M and 9K are uniformly charged in the dark by the corresponding charging units 10Y, 10C, 10M and 10K. Then, the write controller 22 controls the laser light sources LD1 through LD4 via a laser diode controller 23 based on the color image data received from the CPU 40, so as to emit modulated laser beams from the laser light sources LD1 through LD4. In addition, the write controller 22 rotates the polygon mirror 20 via a polygon mirror controller 24. As a result, patterns corresponding to the color image data are exposed on the surfaces of each of the photoconductive bodies 9Y, 9C, 9M and 9K, to thereby form an electrostatic latent image on the surfaces of each of the photoconductive bodies 9Y, 9C, 9M and 9K.

The main scan of the laser beams by the polygon mirror 20 and the sub scan of the laser beams with respect to the transport direction A of the transfer medium 4 are synchronized, by detecting the laser beams that pass through the fθ lens 21 and are reflected by mirrors 25*a* and 25*b* by light receiving elements 26*a* and 26*b* such as photodiodes, and outputting a synchronizing signal to the write controller 22 from a synchronization detection and controller 27 based on outputs of the light receiving elements 26*a* and 26*b*.

The exposure unit 11 also includes an oscillator 28 for generating a reference clock signal, a frequency divider 29 for frequency-dividing the reference clock signal from the oscillator 28 by M (that is, carrying out a 1/M frequency division), a phase locked loop (PLL) circuit 30, and a frequency divider 31 for frequency-dividing an output signal of the PLL circuit 30 by N (that is, carrying out a 1/N frequency division). The oscillator 28, the frequency dividers 29 and 31, and the PLL circuit 30 form a known clock generator. The frequency division values M and N of the frequency dividers 29 and 31 within the clock generator are arbitrarily set by the write controller 22, and the frequency divider outputs to the laser diode controller 23 a signal that is obtained by frequency-dividing the reference clock signal frequency by a frequency division value (N/M). Accordingly, the light emission timings of the laser light sources LD1 through LD4 are adjustable by the laser diode controller 23 depending on the frequency division values M and N that are set by the write controller 22.

The electrostatic latent images formed on the photoconductive bodies 9Y, 9C, 9M and 9K are developed by the corresponding developing units 12Y, 12C, 12M and 12K, and transformed (that is, made visible) into yellow, cyan, magenta and black toner images. The yellow, cyan, magenta and black toner images are transferred onto the transfer medium 4 that is successively transported by the transport belt 5, in an overlapping manner, at respective transfer positions where the photoconductive bodies 9Y, 9C, 9M and 9K oppose the corresponding transfer units 14Y, 14C, 14M and 14K. The overlapping yellow, cyan, magenta and black toner images form a full color toner image on the transfer medium 4. The transfer medium 4 is then separated from the transport belt 5 and is supplied to a fixing unit 15 where the full color toner image is fixed on the transfer medium 4. The transfer medium 4 is thereafter ejected via a medium ejecting unit (not shown). After the yellow, cyan, magenta and black toner images are transferred onto the transfer medium 4, the residual toners on the surfaces of the photoconductive bodies 9Y, 9C, 9M and 9K are removed by the cleaning units 13Y, 13C, 13M and 13K, in order to prepare for the next image formation.

The positioning or alignment of the yellow, cyan, magenta and black toner images that are formed in the overlapping manner on the transfer medium 4 in order to match the overlapping positions is made by setting an exposure start time of each color in the exposure unit 11, so that timings at which the transfer medium 4 is supplied from the medium supply tray 1 and transported by the transport belt 5 to the transfer positions of the yellow, cyan, magenta and black toner images, and timings at which the yellow, cyan, magenta and black toner images on the photoconductive bodies 9Y, 9C, 9M and 9K reach the corresponding transfer positions match for each of the yellow, cyan, magenta and black toner images.

However, the overlapping positions of the yellow, cyan, magenta and black toner images may not match due to an error in a distance separating rotary axes of at least 2 of the photoconductive bodies 9Y, 9C, 9M and 9K, an error in a horizontal alignment of the photoconductive bodies 9Y, 9C, 9M and 9K relative to the transport belt 5, an error in the positioning of elements forming the optical system such as the mirrors 25*a* and 25*b* when the elements are mounted, an error in the write timing or the like. In other words, the toner images of the different colors may be formed at positions deviated from one another due to such errors. Even if an initial adjustment is made to correct such errors, the errors occur when units related to the image formation, such as the photoconductive bodies 9Y, 9C, 9M and 9K and the developing units 12Y, 12C, 12M and 12K, are subjected to maintenance, replacement, transportation or the like. In addition, the errors vary with time (that is, aging) due to expansion of mechanisms depending on the temperature after the image formation is made on a plurality of transfer media 4. For these reasons, it is necessary to make the adjustment at relatively short intervals.

It is known from Japanese Laid-Open Patent Applications No. 11-65208 and No. 2002-244393, for example, that the following 5 kinds of positional errors (color registration errors) exist among the toner images of different colors due to the errors described above.

1) Skew;
2) Registration error in the sub scan direction;
3) Pitch error in the sub scan direction;
4) Registration error in the main scan direction: and
5) Magnification (or zoom) error in the main scan direction.

The Japanese Laid-Open Patent Application No. 2002-244393 has a corresponding U.S. patent application Ser. No. 11/206,086 filed Aug. 18, 2005 (U.S. Patent Application Publication US 2006/0039722 A1). The disclosures of the Japanese Laid-Open Patent Applications No. 11-65208 and No. 2002-244393 and the U.S. patent application Ser. No. 11/206,086 are hereby incorporated by reference, and methods proposed thereby will hereinafter be referred to as "the previously proposed method".

Figure 6:
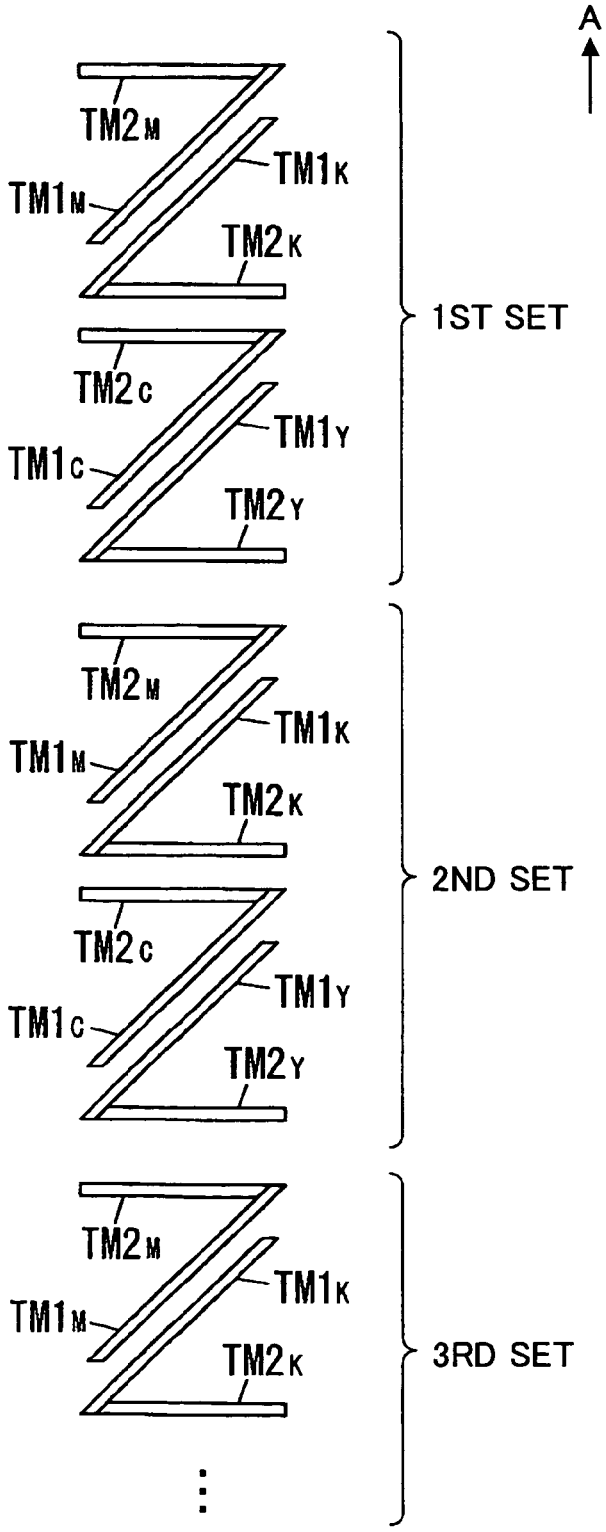
FIG. 6 is a plan view showing a first pattern of toner images for correction.

Accordingly, in the image forming apparatus of this embodiment, the color registration error of each color is corrected or, calibrated, prior to actually forming the color image on the transfer medium 4, in a similar manner to the previously proposed method. In other words, toner images $TMn_Y$, $TMn_C$, $TMn_M$ and $TMn_K$ (n=1, 2) for correction having a pattern shown in FIG. 6 are formed on the transport belt 5 for use in calibrating the color registration errors for the colors yellow, cyan, magenta and black. FIG. 6 is a plan view showing a first pattern of the toner images for correction. The pattern of the toner images $TMn_Y$, $TMn_C$, $TMn_M$ and $TMn_K$ is detected by a detection means, and the CPU 40 obtains the color registration error that is generated for each of the colors yellow, cyan, magenta and black, based on a detection result of the detection means. The color registration error is corrected or, calibrated, by varying the setting of the exposure start time of the exposure unit 11, for example. The detection means is formed by 3 detection units 16 (only 2 detection units 16 shown in FIG. 4) opposing the transport belt 5 and arranged at both end portions and a central portion of the transport belt 5 along the main scan direction, and a detector controller 17 for controlling the 3 detection units 16.

In FIG. 6 and FIGS. 8 through 11 which will be described later, first, second and subsequent sets of toner images are formed on the transfer body as the transport belt 5 is transported in the transport direction A. Each set of toner images includes the first and second toner images of each of the four colors yellow (Y), cyan (C), magenta (M) and black (K).

Figure 7:
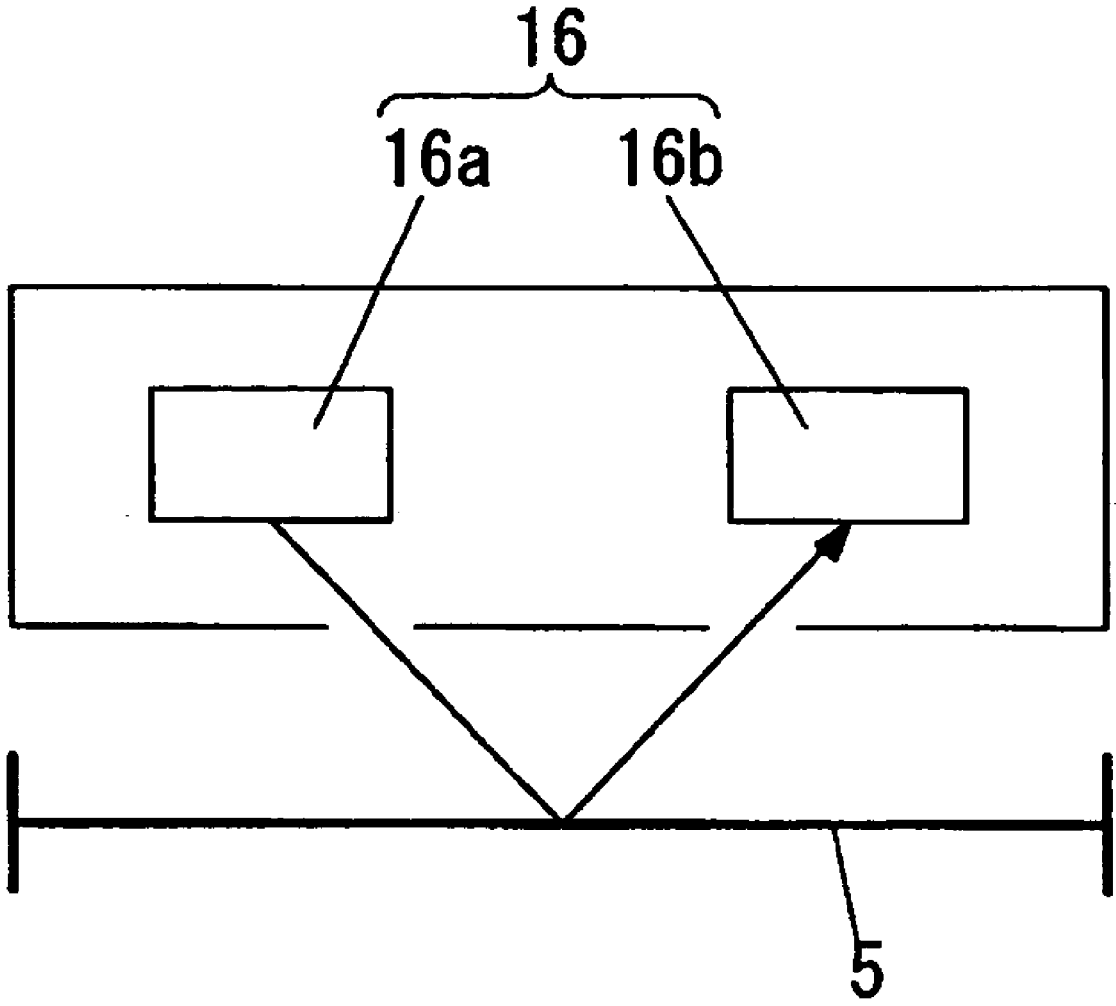
FIG. 7 is a schematic diagram showing a general structure of a detection unit.

FIG. 7 is a schematic diagram showing a general structure of the detection unit 16. As shown in FIG. 7, the detection unit 16 includes a light emitting element 16*a* and a light receiving element 16*b* which are arranged to oppose the transport belt 5. Light emitted from the light emitting element 16*a* under control of the detector controller 17 is reflected by the surface of the transport belt 5, and the reflected light from the surface of the transport belt 5 is detected by the light receiving element 16*b*. The surface of the transport belt 5 has a reflectance higher than that of each of the yellow, cyan, magenta and black toners. A detection signal that has a level corresponding to an amount of light detected is output from the light receiving element 16*b* and is input to the CPU 40 via an analog-to-digital (A/D) converter 54 that carries out an A/D conversion. Hence, when the amount of the reflected light from the transport belt 5 decreases due to the toner images $TMn_Y$, $TMn_C$, $TMn_M$ and $TMn_K$ on the transport belt 5, the amount of the light detected by the light receiving element 16*b* shows a corresponding decrease, thereby making it possible to detect the timings at which the toner images $TMn_Y$, $TMn_C$, $TMn_M$ and $TMn_K$ pass the detection unit 16.

A detailed description on the pattern of the toner images for correction used in this embodiment will be given later. A brief description will now be given of a color registration error correction (or calibration) means of the previously proposed method, which may also be used in this embodiment.

The color registration error correction means is formed by the CPU 40, a ROM 41 which stores a program for correcting the color registration error (color registration error correction (or calibration) program) and programs for carrying out other processes, and a RAM 42 which provides a work region that is required when the CPU 40 executes the programs. The color registration error is corrected by the color registration error correction means when the CPU 40 executes the color registration error correction program that is stored in the ROM 41.

The CPU 40 obtains the amount of each of the 5 kinds of color registration errors described above, based on a relative error (time difference) between the detected position of the black toner image $TMn_Y$ and the detected positions of the other toner images $TMn_C$, $TMn_M$ and $TMn_K$ that are detected by the detection unit 16, and a designed value of a transport velocity of the transport belt 5. The CPU 40 carries out the corrections described in the Japanese Laid-Open Patent Application No. 2002-244393 and described briefly hereunder so as to eliminate the 5 kinds of color registration errors. The method of calculating the 5 kinds of color registration errors are known from the Japanese Laid-Open Patent Application No. 11-65208, for example, and a detailed description thereof will be omitted.

First, a description will be given of the correction of the skew error. The skew error is corrected by changing inclinations of the mirrors 25*a* and 25*b* of the exposure unit 11. The inclinations of the mirrors 25*a* and 25*b* may be changed by driving a mechanism (not shown) having adjustable inclinations for the mirrors 25*a* and 25*b* by use of a stepping motor (not shown).

The color registration errors in the sub and main scan directions and the pitch error in the sub scan direction are corrected by sending an instruction from the CPU 40 to the write controller 22, so that the laser diode controller 23 advances or delays the laser beam emission timings (write start timings) of the laser light sources LD1 through LD4 with respect to the synchronizing signal that is output from the synchronization detection and controller 27, depending on the amount of each of the color registration errors in the sub and main scan directions and the pitch error in the sub scan direction. The main scan direction is perpendicular to the sub scan direction. The sub scan direction is basically in a reverse direction to the transport direction A.

In addition, the magnification error in the main scan direction is corrected by sending an instruction from the CPU 40 to the write controller 22, so that a clock signal output from the clock generator within the exposure unit 11 is adjusted depending on the amount of the magnification error in the main scan direction.

Next, a description will be given of the pattern of the toner images for correction used in this embodiment.

Figure 1:
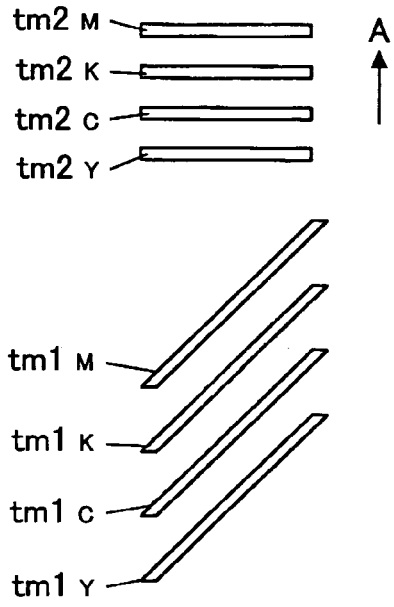
FIG.1 PRIOR ART
FIG. 1 is a plan view showing an example of a pattern of conventional toner images for correction.
Figure 2:
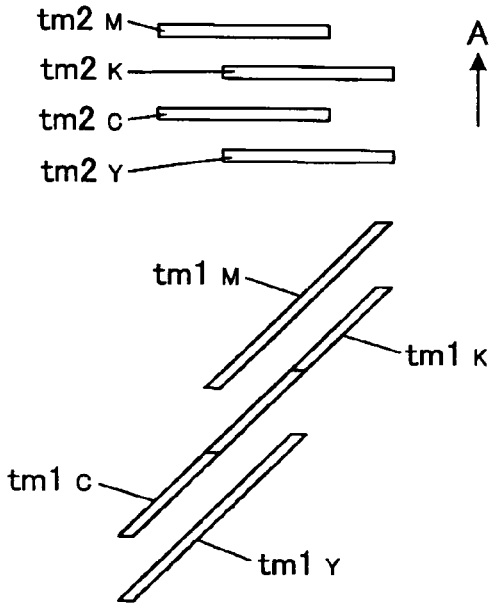
FIG.2 PRIOR ART
FIG. 2 is a plan view showing an overlap of the pattern of the toner images for correction shown in FIG. 1.

The conventional toner images $tmn_Y$, $tmn_C$, $tmn_K$ and $tmn_M$ for correction include the first toner images $tm1_Y$, $tm1_C$, $tm1_K$ and $tm1_M$ made up of the strips that have the linear portion forming the angle of 45 degrees with respect to both the main and sub scan directions, and the second toner images $tm2_Y$, $tm2_C$, $tm2_K$ and $tm2_M$ made up of the strips that are arranged at the predetermined intervals in the sub scan direction and have the linear portion parallel to the main scan direction, as shown in FIG. 1. However, because the toner images $tmn_Y$, $tmn_C$, $tmn_K$ and $tmn_M$ for correction are arranged at both ends of the transfer belt along the main scan direction, the effects of the errors, such as the error in the optical system of the exposure unit, appear conspicuously in terms of the positions where the toner images $tmn_Y$, $tmn_C$, $tmn_K$ and $tmn_M$ are formed. In particular, the first toner image $tm1_Y$ or $tm1_C$ that is formed by reflecting the corresponding laser beam by one reflection surface of the polygon mirror and the first toner image $tm1_K$ or $tm1_M$ that is formed by simultaneously reflecting the corresponding laser beam by another reflection surface of the polygon mirror shift in the main scan direction due to the effects of the errors. Consequently, depending on the error, the first toner image $tm1_C$ and the first toner image $tm1_K$ may be formed in the overlapping manner as shown in FIG. 2, for example, and in such a case, it becomes impossible to detect the first toner images $tm1_C$ and $tm1_K$ in a normal manner.

On the other hand, according to this embodiment, of the first toner images $TM1_Y$, $TM1_C$, $TM1_M$ and $TM1_K$ for correction, the first toner images which are exposed by the laser beams that are simultaneously reflected by different reflection surfaces of the polygon mirror 20 are arranged at positions such that no overlap of the first toner images will occur even if the first toner images shift in parallel along the main scan direction due to the color registration error. In the pattern shown in FIG. 6, the first toner image $TM1_Y$ or $TM1_C$ that is formed by reflecting the corresponding laser beam by one reflection surface of the polygon mirror 20 and the first toner image $TM1_K$ or $TM1_M$ that is formed by simultaneously reflecting the corresponding laser beam by another reflection surface of the polygon mirror 20 are arranged at positions such that the first toner image $TM1_Y$ or $TM1_C$ and the first toner image $TM1_K$ or $TM1_M$ will not overlap even if the first toner image $TM1_Y$ or $TM1_C$ and the first toner image $TM1_K$ or $TM1_M$ shift in parallel along the main scan direction due to the color registration error.

As shown in FIG. 6, a separation between a trailing end (downstream side along the transport direction A) of the first black toner image $TM1_K$ and a leading end (upstream side along the transport direction A) of the first cyan toner image $TMl_C$ along the sub scan direction is large compared to that of the conventional pattern shown in FIG. 1. As shown in FIG.6, $TM1_K$ and $TM1_M$ are adjacent to each other and derive from a same reflection surface of the polygon mirror 20, and $TM1_Y$ and $TM1_C$ are also adjacent to each other and derive from another same reflection surface of the polygon mirror 20. $TM1_K$ and $TM1_c$ are the closest-to-each-other first toner images which derive from different reflection surfaces of the polygon mirror 20. Accordingly, even if the first toner image $TM1_Y$ or $TM1_C$ that is formed by reflecting the corresponding laser beam by one reflection surface of the polygon mirror 20 and the first toner image $TM1_{K\ or\ TM1M}$ that is formed by simultaneously reflecting the corresponding laser beam by another reflection surface of the polygon mirror 20 shift in parallel along the main scan direction due to the color registration error, it is possible to prevent the first cyan toner image $TMI_C$ and the first black toner image $TM1_K$ from overlapping each other, which would otherwise make it impossible to detect the first toner images $TM1_C$ and $TM1_K$ in a normal manner.

When correcting or calibrating the color registration error, the first and second toner images $TMn_Y$, $TMn_C$, $TMn_M$ and $TMn_K$ for correction are formed on the transfer body which may either be the transport belt 5 or the transfer medium 4.

One set of the first and second toner images for correction is formed for every one-half period of rotation of the corresponding one of the photoconductive bodies 9Y, 9C, 9M and 9K in the sub scan direction, in a linear arrangement at both the end portions and the central portion of the transport belt 5 along the main scan direction. For example, a total of 24 sets of the first and second toner images for correction are formed. The sets of the first and second toner images for correction are formed at intervals of one-half period of rotation of the photoconductive bodies 9Y, 9C, 9M and 9K, because if it is assumed that a deviation in the amount of the color registration error in one period of rotation of the photoconductive bodies 9Y, 9C, 9M and 9K displays a sinusoidal curve, it is theoretically possible to detect a center value of the deviation (that is, the deviation can be cancelled) by detecting and averaging the pair of first and second toner images $TM1_Y$, $TM1_C$, $TM1_M$ and $TM1_K$ for correction that are formed at the intervals of one-half period of rotation of the photoconductive bodies 9Y, 9C, 9M and 9K, as disclosed in the Japanese Laid-Open Patent Application No. 11-65208.

If the second toner images $tm2_Y$, $tm2_C$, $tm2_M$ and $tm2_K$ for correction are arranged together on the upstream side of the first toner images $tm1_Y$, $tm1_C$, $tm1_M$ and $tm1_K$ for correction along the transport direction A as in the conventional case shown in FIG. 1, the separation between the trailing end of the first black toner image $tm1_K$ and the leading end of the second toner image $tm2_C$ along the sub scan direction becomes large, making the separation between the first yellow toner image $tm1_Y$ and the second magenta toner image $tm2_M$ large. Consequently, the time required to correct or calibrate the color registration error becomes long.

On the other hand, in the pattern shown in FIG. 6, the first yellow and cyan toner images $TM1_Y$ and $TM1_C$ that are formed by reflecting the corresponding laser beams by one reflection surface of the polygon mirror 20 are arranged adjacent to each other in the sub scan direction, and the second yellow and cyan toner images $TM2_Y$ and $TM2_C$ that are formed by reflecting the corresponding laser beams by the one reflection surface of the polygon mirror 20 are arranged so as to sandwich the first yellow and cyan toner images $TM1_Y$ and $TM1_C$ along the sub scan direction. In addition, the first magenta and black toner images $TM1_M$ and $TM1_K$ that are formed by reflecting the corresponding laser beams by another reflection surface of the polygon mirror 20 are arranged adjacent to each other in the sub scan direction, and the second magenta and black toner images $TM2_K$ and $TM2_M$ that are formed by reflecting the corresponding laser beams by the other reflection surface of the polygon mirror 20 are arranged to sandwich the first magenta and black toner images $TM1_M$ and $TM1_K$ along the sub scan direction. Hence, the length of the pattern made up of one set of the first and second toner images for correction along the sub scan direction can be reduced compared to that of the conventional pattern shown in FIG. 1, and as a result, it is possible to reduce the time required to correct or calibrate the color registration error.

In the pattern shown in FIG. 6, the first toner image of one color is arranged on a downstream side relative to the second toner image of this one color along the transport direction A. The order in which the colors of the first toner images are arranged and the order in which the colors of the second toner images are arranged along the transport direction A are the same. However, the pattern of the toner images for correction is not limited to the first pattern shown in FIG. 6, and the order of the first and second toner images for correction may be reversed with respect to the transport direction A.

For each set, the first toner image of one color may be formed before the second toner image of this one color or, vice versa. In other words, the order in which the first toner image and the second toner image of the same color are formed may be set arbitrarily. In addition, the order in which the toner images of the four colors Y, C, M and K are formed may be set arbitrarily. Furthermore, the order in which the first, second, third and fourth image processing parts 6Y, 6C, 6M and 6K are arranged along the transport direction A is not limited to the order shown in FIG. 3, and this arrangement order may be set arbitrarily. The order in which the first, second, third and fourth image processing parts 6Y, 6C, 6M and 6K are arranged along the transport direction A does not necessarily have to match the order in which the toner images of the four colors Y, C, M and K are to be formed.

In addition, although the toner images $TM1_Y$ and $TM2_Y$, the toner images $TM1_C$ and $TM2_C$, the toner images $TM1_K$ and $TM2_K$, and the toner images $TM1_M$ and $TM2_M$, each of which forms a pair of the same color are connected in FIG. 6, a gap may be formed between the toner images forming the pair so that the toner images forming the pair of the same color are not connected to each other. Moreover, the colors of the 2 toner images sandwiching 2 adjacent toner images or, the color of the 2 adjacent toner images sandwiched between 2 toner images may be different from those shown in FIG. 6.

Figure 8:
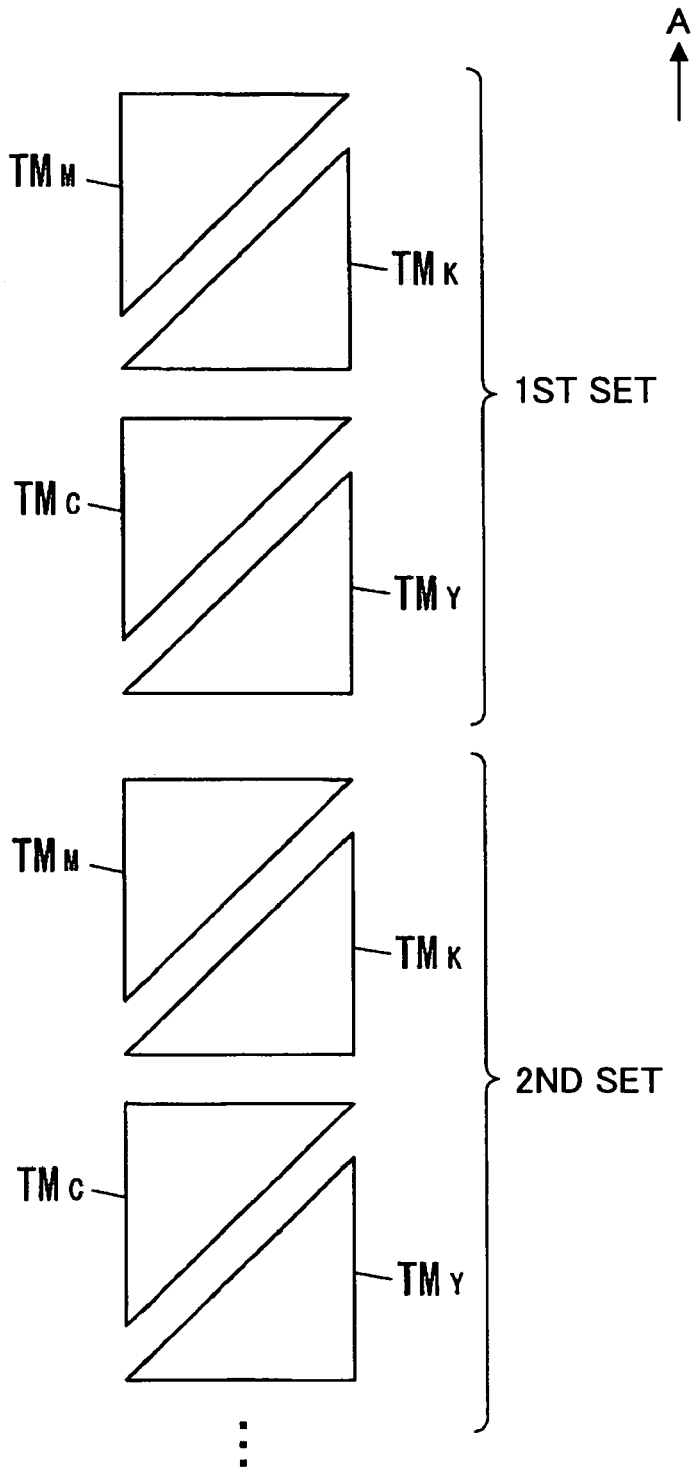
FIG. 8 is a plan view showing a second pattern of the toner images for correction.

FIG. 8 is a plan view showing a second pattern of the toner images for correction. In the pattern shown in FIG. 8, toner images $TM_Y$, $TM_C$, $TM_M$ and $TM_K$ for correction, having a triangular shape such as that of a right-angled isosceles triangle, are formed in a linear arrangement instead of forming the two kinds of toner images that are made up of the first and second toner images $TMn_Y$, $TMn_C$, $TMn_M$ and $TMn_K$ for correction. The toner images $TM_Y$, $TM_C$, $TM_M$ and $TM_K$ for correction include both the linear portion parallel to the main scan direction and the linear portion at a 45-degree angle to both the main and sub scan direction of each of the first and second toner images $TMn_Y$, $TMn_C$, $TMn_M$ and $TMn_K$ for correction. In the pattern shown in FIG. 8, a space between the linear portion parallel to the main scan direction and the linear portion at the 45-degree angle to both the main and sub scan direction is filled by the toner image, for each of the toner images $TM_Y$, $TM_C$, $TM_M$ and $TM_K$ for correction. For this reason, it is possible to minimize the effects of scratches or the like on the transport belt 5, which may otherwise cause the first and second toner images $TMn_Y$, $TMn_C$, $TMn_M$ and $TMn_K$ for correction to become segmented or discontinuous.

Of course, the order in which the toner images $TM_Y$, $TM_C$, $TM_M$ and $TM_K$ for correction are arranged along the transport direction A is not limited to the order shown in FIG. 8.

Figure 9:
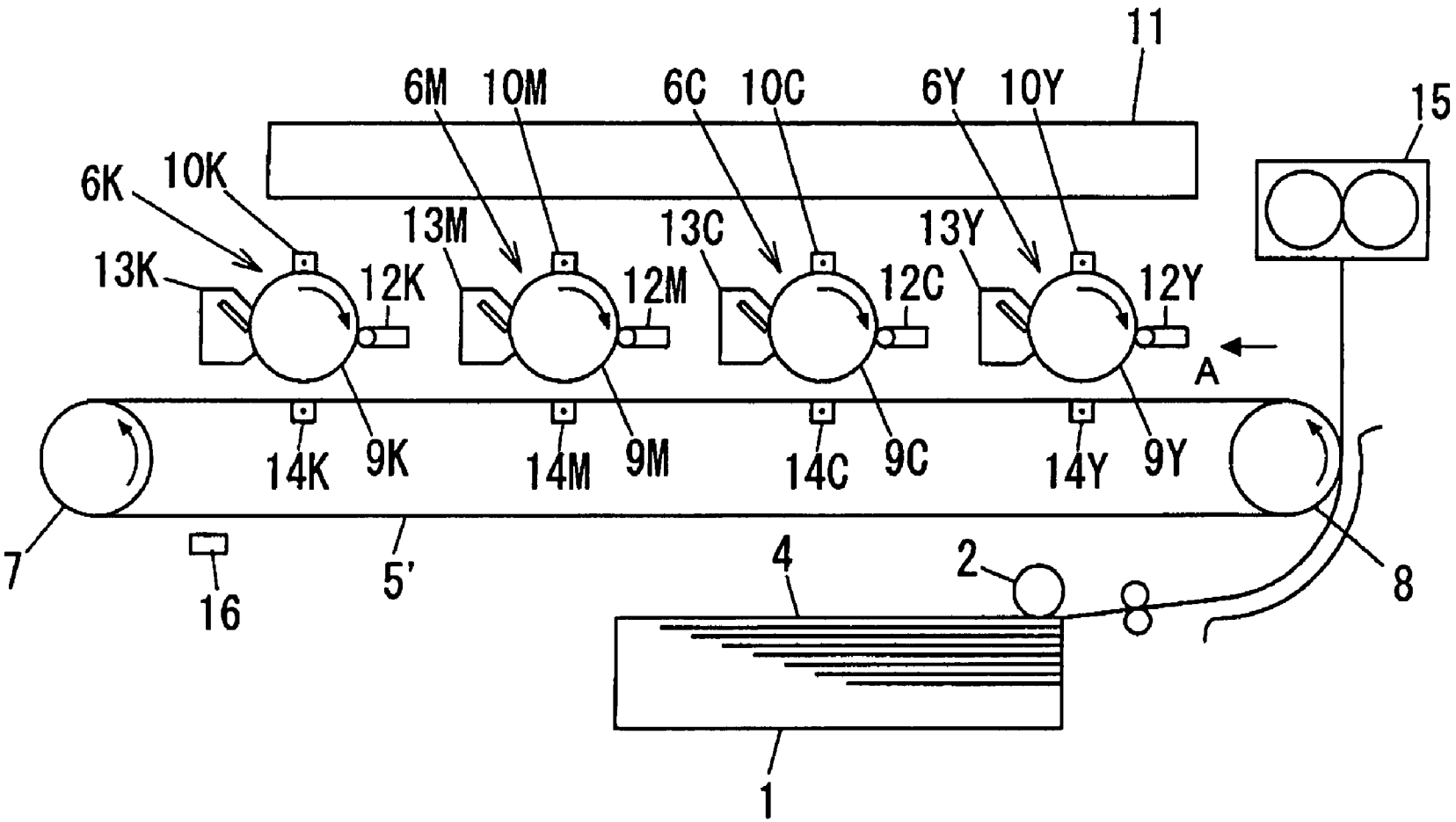
FIG. 9 is a schematic diagram showing a general structure of a part of an image forming apparatus in another embodiment of the present invention.

FIG. 9 is a schematic diagram showing a general structure of a part of an image forming apparatus in another embodiment of the present invention. In FIG. 9, those parts that are the same as those corresponding parts in FIG. 3 are designated by the same reference numerals, and a description thereof will be omitted.

In the embodiment described above, the present invention is applied to the image forming apparatus shown in FIG. 3, of the type which transfers the toner images from the first, second, third and fourth image parts 6Y, 6C, 6M and 6K directly onto the transfer medium 4. However, the present invention is similarly applicable to the type of image forming apparatus shown in FIG. 9. That is, in FIG. 9, all of the toner images from the first, second, third and fourth image parts 6Y, 6C, 6M and 6K are once transferred onto an intermediate transfer belt 5' by a primary transfer, and the full color image on the intermediate transfer belt 5' is then transferred onto the transfer medium 4 by a secondary transfer. The toner images for correction may be formed on the intermediate transfer belt 5' in a manner similar to that described above with respect to the toner images for correction formed on the transport belt 5 or transfer medium 4.

Further, in the embodiments described above, the toner images for correction include the linear portion parallel to the main scan direction and the linear portion at the 45-degree angle to both the main and sub scan direction. However, the latter linear portion may be arranged at an angle greater than 0 and less than 90 degrees with respect to the sub scan direction, that is, the transport direction A of the transfer medium.

Therefore, according to each of the embodiments described above, the toner images for correction, that have different colors and are formed by the laser beams which are reflected by different reflection surfaces of the polygon mirror, are formed on the transfer body, which may be one of the transport belt, the transfer medium and the intermediate transfer belt, with an arrangement such that even if the toner images shift in parallel along the main scan direction of the scan made by the rotating polygon mirror due to the color registration error, it is possible to prevent the toner images from overlapping each other, which overlap would otherwise make it impossible to detect the toner images in a normal manner. In addition, the first toner images that are formed by reflecting the corresponding laser beams by one reflection surface of the polygon mirror are arranged adjacent to each other in the sub scan direction, and the second toner images that are formed by reflecting the corresponding laser beams by the same one reflection surface of the polygon mirror are arranged so as to sandwich the first toner images along the sub scan direction. For this reason, the length of the pattern made up of one set of the first and second toner images for correction along the sub scan direction can be reduced compared to that of the conventional pattern shown in FIG. 1, and as a result, it is possible to reduce the time required to correct or calibrate the color registration error.

This application claims the benefit of a Japanese Patent Application No. 2007-003914 filed Jan. 11, 2007, in the Japanese Patent Office, the disclosure of which is hereby incorporated by reference.

Further, the present invention is not limited to these embodiments, but various variations and modifications may be made without departing from the scope of the present invention.

What is claimed is:

1. An image forming method comprising:

exposing a plurality of image bearing members by simultaneously reflecting a plurality of light beams from a plurality of light sources by different reflection surfaces of a polygon mirror which has a plurality of reflection surfaces and is rotated in one direction, said plurality of light beams corresponding to a plurality of different colors;

transforming electrostatic latent images formed on each of the plurality of image bearing members into toner images for correction;

transferring the toner images on each of the image bearing members onto a transfer body that is transported in a transport direction; and calibrating overlapping positions of the toner images based on an optical detection of the toner images on the transfer body, wherein the toner images are arranged at positions on the transfer body such that the toner images derived from one of the different reflection surfaces have no overlap with the toner images derived from another one of the reflection surfaces even if the toner images shift in a direction perpendicular to the transport direction due to a color registration error, each of the toner images on the transfer body includes a first toner image having a linear portion arranged at an angle greater than 0 and less than 90 degrees with respect to the transport direction, and a second toner image having a linear portion arranged perpendicularly to the transport direction, two first toner images simultaneously formed by two corresponding light beams reflected by one reflection surface of the polygon mirror are arranged adjacent to each other in the transport direction, and two second toner images simultaneously formed by said two corresponding light beams reflected by said one reflection surface of the polygon mirror are arranged to sandwich the two first toner images along the transport direction, and a distance between two closest-to-each-other first toner images on the transfer body which derive from different reflection surfaces of the polygon mirror is longer than that between first toner images which are positioned so as to be adjacent to each other on the transfer body and derive from a same reflection surface of the polygon mirror.

2. The image forming method as claimed in claim 1, wherein an order in which the colors of the first toner images are arranged and an order in which the colors of the second toner images are arranged along the transport direction are the same.

3. The image forming method as claimed in claim 2, wherein each of the two second toner images is connected to one of the two first toner images that are sandwiched by the two second toner images.

4. The image forming method as claimed in claim 2, wherein each of the two second toner images is separated by a gap from each of the two first toner images that are sandwiched by the two second toner images.

5. The image forming method as claimed in claim 2, wherein each toner image for correction has a triangular shape including the first and second toner images of one color.

6. The image forming method as claimed in claim 1, wherein said transferring transfers the toner images onto the transfer body in a linear arrangement along the transport direction.

7. The image forming method as claimed in claim 1, wherein said calibrating calibrates the overlapping positions of the toner images based on an averaged result of the optical detection of the toner images on the transfer body.

8. The image forming method as claimed in claim 1, wherein only two second toner images are formed on the transfer body between the two closest-to-each-other first toner images which derive from the different reflection surfaces of the polygon mirror.

9. An image forming apparatus comprising:

a plurality of image bearing members;

an exposure unit configured to simultaneously reflect a plurality of light beams from a plurality of light sources by different reflection surfaces of a polygon mirror which has a plurality of reflection surfaces and is rotated in one direction, said plurality of light beams corresponding to a plurality of different colors;

an image processing unit configured to transform electrostatic latent images formed on each of the plurality of image bearing members into toner images for correction, and to transfer the toner images on each of the image bearing members onto a transfer body that is transported in a transport direction; and a processing unit configured to calibrate overlapping positions of the toner images based on an optical detection of the toner images on the transfer body, wherein the toner images are arranged at positions on the transfer body such that the toner images derived from one of the different reflection surfaces have no overlap with the toner images derived from another one of the reflection surfaces even if the toner images shift in a direction perpendicular to the transport direction due to a color registration error, each of the toner images on the transfer body includes a first toner image having a linear portion arranged at an angle greater than 0 and less than 90 degrees with respect to the transport direction, and a second toner image having a linear portion arranged perpendicularly to the transport direction, two first toner images simultaneously formed by two corresponding light beams reflected by one reflection surface of the polygon mirror are arranged adjacent to each other in the transport direction, and two second toner images simultaneously formed by said two corresponding light beams reflected by said one reflection surface of the polygon mirror are arranged to sandwich the two first toner images along the transport direction, and a distance between two closest-to-each-other first toner images on the transfer body which derive from different reflection surfaces of the polygon mirror is longer than that between first toner images which are positioned so as to be adjacent to each other on the transfer body and derive from a same reflection surface of the polygon mirror.

10. The image forming apparatus as claimed in claim 9, wherein the transfer body is one of a transport belt which transports a transfer medium onto which a full color image is to be formed, the transfer medium, and an intermediate transfer medium onto which a full color image is transferred by a primary transfer and then transferred onto the transfer medium by a secondary transfer.

11. The image forming apparatus as claimed in claim 10, wherein an order in which the colors of the first toner images are arranged and an order in which the colors of the second toner images are arranged along the transport direction are the same.

12. The image forming apparatus as claimed in claim 11, wherein each of the two second toner images is connected to one of the two first toner images that are sandwiched by the two second toner images.

13. The image forming apparatus as claimed in claim 11, wherein each of the two second toner images is separated by a gap from each of the two first toner images that are sandwiched by the two second toner images.

14. The image forming apparatus as claimed in claim 11, wherein each toner image for correction has a triangular shape including the first and second toner images of one color.

15. The image forming apparatus as claimed in claim 9, wherein said image processing unit transfers the toner images on the transfer body in a linear arrangement along the transport direction.

16. The image forming apparatus as claimed in claim 9, wherein said processing unit calibrates the overlapping positions of the toner images based on an averaged result of the optical detection of the toner images on the transfer body.

17. A toner image pattern for use by an image forming method or apparatus which exposes a plurality of image bearing members by simultaneously reflecting a plurality of light beams from a plurality of light sources by different reflection surfaces of a polygon mirror which has a plurality of reflection surfaces and is rotated in one direction, said plurality of light beams corresponding to a plurality of different colors; transforms electrostatic latent images formed on each of the plurality of image bearing members into toner images for correction; transfers the toner images on each of the image bearing members onto a transfer body that is transported in a transport direction; and calibrates overlapping positions of the toner images based on an optical detection of the toner images on the transfer body, said toner image pattern comprising:

the toner images arranged at positions on the transfer body such that the toner images derived from one of the different reflection surfaces have no overlap with the toner images derived from another one of the reflection surfaces even if the toner images shift in a direction perpendicular to the transport direction due to a color registration error;

wherein each of the toner images on the transfer body includes a first toner image having a linear portion arranged at an angle greater than 0 and less than 90 degrees with respect to the transport direction, and a second toner image having a linear portion arranged perpendicularly to the transport direction;

two first toner images simultaneously formed by two corresponding light beams reflected by one reflection surface of the polygon mirror are arranged adjacent to each other in the transport direction, and two second toner images simultaneously formed by said two corresponding light beams reflected by said one reflection surface of the polygon mirror are arranged to sandwich the two first toner images along the transport direction and a distance between two closest-to-each-other first toner images on the transfer body which derive from different reflection surfaces of the polygon mirror is longer than that between first toner images which are positioned so as to be adjacent to each other on the transfer body and derive from a same reflection surface of the polygon mirror.

18. The toner image pattern as claimed in claim 17, wherein an order in which the colors of the first toner images are arranged and an order in which the colors of the second toner images are arranged along the transport direction are the same.

19. The toner image pattern as claimed in claim 18, wherein each of the two second toner images is connected to one of the two first toner images that are sandwiched by the two second toner images.

20. The toner image pattern as claimed in claim 18, wherein each of the two second toner images is separated by a gap from each of the two first toner images that are sandwiched by the two second toner images.

21. The toner image pattern as claimed in claim 18, wherein each toner image for correction has a triangular shape including the first and second toner images of one color.

* * * * *